US007213296B2

(12) United States Patent
Livingstone et al.

(10) Patent No.: US 7,213,296 B2
(45) Date of Patent: May 8, 2007

(54) SPREADING APPARATUS FOR FLOWABLE MATERIALS AND SPREADER PAD THEREFOR

(75) Inventors: David E. Livingstone, Harrietsville (CA); Donald W. Matechuk, Niagara Falls (CA)

(73) Assignee: Billy Star Holding Ltd, Niagara Falls (CA)

( * ) Notice: Subject to any disclaimer, the term of this patent is extended or adjusted under 35 U.S.C. 154(b) by 263 days.

(21) Appl. No.: 10/983,615

(22) Filed: Nov. 9, 2004

(65) Prior Publication Data

US 2006/0005339 A1 Jan. 12, 2006

Related U.S. Application Data

(63) Continuation-in-part of application No. 10/883,759, filed on Jul. 6, 2004.

(51) Int. Cl.
*B05C 17/00* (2006.01)

(52) U.S. Cl. ..... 15/245.1; 15/105; 15/244.1; 118/264; 401/139

(58) Field of Classification Search ..... 15/105, 15/121, 235.4, 235.6, 244.1, 245.1; 118/264, 118/266–268; 401/203, 207, 138, 140, 139
See application file for complete search history.

(56) References Cited

U.S. PATENT DOCUMENTS

| | | | | |
|---|---|---|---|---|
| 1,033,222 A | | 7/1912 | Whitehead | |
| 1,049,797 A | | 1/1913 | Arntt | |
| 2,073,170 A | | 3/1937 | Pieper | |
| 3,038,188 A | * | 6/1962 | Rebernak | 15/119.2 |
| 3,134,129 A | | 5/1964 | Allen | |
| 3,366,988 A | * | 2/1968 | Ginter et al. | 15/244.1 |
| 4,077,083 A | * | 3/1978 | Siemund et al. | 15/244.1 |
| 4,991,989 A | | 2/1991 | Fitjer | |
| 5,575,032 A | * | 11/1996 | Cernuska | 15/119.2 |
| 5,937,628 A | | 8/1999 | Matechuk | |
| 6,325,563 B1 | | 12/2001 | Matechuk | |
| 6,540,423 B1 | | 1/2003 | Kugler et al. | |
| 6,655,866 B1 | | 12/2003 | Morad et al. | |
| 6,695,516 B2 | | 2/2004 | DeFields et al. | |
| 2002/0124338 A1 | * | 9/2002 | McCormick, Jr. | 15/119.2 |

FOREIGN PATENT DOCUMENTS

| | | |
|---|---|---|
| CA | 2247132 A1 | 3/1999 |
| CA | 2345488 A1 | 11/2001 |

* cited by examiner

*Primary Examiner*—Mark Spisich
(74) *Attorney, Agent, or Firm*—Standley Law Group LLP

(57) ABSTRACT

A spreading apparatus is provided for spreading flowable materials such as adhesives and/or sealants on a surface such as a floor and/or a wall. The apparatus has a pad retainer for retaining a removable spreader pad and a reservoir chamber for flowable material pivotally attached to the pad retainer to permit pivoting of the reservoir chamber frontwards and backwards. The spreader pad comprises an elongated resilient foam member sufficiently thick to fit within and frictionally engage the pad retainer, and sufficiently high to extend below the pad retainer so that the spreader pad rather than the pad retainer contacts the surface when the spreader pad is retained by the pad retainer.

12 Claims, 10 Drawing Sheets

SPREADING APPARATUS FOR FLOWABLE MATERIALS AND SPREADER PAD THEREFOR

CROSS-REFERENCE TO RELATED APPLICATIONS

This application is a continuation-in-part of U.S. patent application Ser. No. 10/883,759 filed on Jul. 6, 2004.

FIELD OF THE INVENTION

This invention relates to spreading apparatuses for flowable materials, in particular to spreading apparatuses for spreading flowable adhesives and/or sealants on a surface. This invention also relates to spreader pads for the spreading apparatuses.

BACKGROUND OF THE INVENTION

A number of service industries in which a decorative or protective finish is applied to a surface employ an adhesive and/or sealant for that purpose. The adhesive and/or sealant must be spread uniformly as a thin coating on the surface. A particular industry with such a requirement is the installation of coverings on floors and/or walls. Coverings may be, for example, carpet, sheet plastic (e.g. vinyl), plastic tiles, ceramic tiles, composite strips and wood strips.

Adhesives and sealants are generally supplied in a variety of containers of the type also generally used for paints. Thus, small quantities of a liter or part liter are supplied in metal cans with press-on lids, while larger quantities, e.g. 20 or 40 liters, are supplied in small plastic drums with snap-on lids. Irrespective of the size of the surface that is to be coated, the usual method of application is for a quantity of the material to be poured onto the surface, if it is sufficiently easily flowable, or if too viscous to be poured easily, for small quantities to be scooped from the container and dumped on the surface. It is then spread uniformly by the operator, kneeling when the surface is a floor, employing for the purpose a metal or plastics hand tool of approximately rectangular shape, usually about 20 cm (8 ins) in width, the longer straight edge which engages the floor being toothed or serrated in a regular pattern so as to provide a row of uniform-size, uniformly-spaced gaps whereby corresponding uniform-size, uniformly parallel spaced lines of the adhesive are formed on the surface as the tool is dragged over it, the surplus material being pressed ahead of the tool and escaping around the edges. Such operations are labour-intensive and also tend to be somewhat messy unless the operator is particularly careful, especially as the container is emptied, when it becomes more difficult to extract the remaining material therefrom.

To mitigate against the problems in the art, there have been developed manually operable spreading apparatuses to assist in spreading flowable materials on to a surface. Such apparatuses are disclosed in U.S. Pat. No. 5,937,628 issued Aug. 17, 1999 and U.S. Pat. No. 6,325,563 issued Dec. 4, 2001, both in the name of William Matechuk. While these apparatuses are an improvement over the labour-intensive methods described above, there still remains a need for a spreading apparatus with improved spreading characteristics and improved ease of use.

SUMMARY OF THE INVENTION

In a first aspect of the invention, there is provided a spreading apparatus comprising: a pad retaining means for retaining a removable spreader pad for spreading a flowable material on a surface, the pad retaining means having a width over which the spreading pad spreads the flowable material; a reservoir chamber for flowable material comprising a front, a back and a bottom, the reservoir chamber pivotally attached to the pad retaining means to permit pivoting of the reservoir chamber frontwards and backwards, the reservoir chamber further comprising an adjustable gate through which the flowable material may exit the reservoir chamber when the gate is open, the gate proximal the bottom of the reservoir chamber and complementary to the width of the pad retaining means; and, a handle attached to and extending from the reservoir chamber.

In a second aspect of the invention, there is provided a spreading apparatus comprising: a pad retaining means for retaining a removable spreader pad for spreading a flowable material on a surface; a reservoir chamber for flowable material comprising an adjustable gate through which the flowable material may exit the reservoir chamber when the gate is open; a hollow handle connected to either or both of the pad retaining means and the reservoir chamber; and, a gate opening means attached to the handle, the gate opening means comprising an actuator and a cable, one end of the cable connected to the actuator and another end of the cable connected to the gate, the cable being housed within the hollow handle.

In a third aspect of the invention, there is provided a spreading apparatus comprising: a pad retaining means for retaining a removable spreader pad for spreading a flowable material on a surface; a reservoir chamber for flowable material attached to the pad retaining means, the reservoir chamber comprising an adjustable gate through which the flowable material may exit the reservoir chamber when the gate is open; and a handle pivotally attached to and extending from the reservoir chamber.

There is further provided a system comprising: a spreading apparatus as described above; a removable spreader pad for spreading the flowable material on the surface, the spreader pad removably retained by the pad retaining means by frictional engagement of the spreader pad with the pad retaining means; and, a container containing the flowable material, the container adapted to be housed in the reservoir chamber comprising an adjustable gate and adapted to cooperate with the gate to permit the flowable material to exit the container and the reservoir chamber when the gate is open.

There is yet further provided a spreader pad for use with a spreading apparatus as described above, the pad comprising an elongated resilient foam member sufficiently thick to fit within and frictionally engage the pad retaining means of the spreading apparatus, and sufficiently high to extend below the pad retaining means so that the spreader pad rather than the pad retaining means contacts the surface when the spreader pad is retained by the pad retaining means.

The reservoir chamber is a space in which a supply of flowable material may be stored in the spreading apparatus. Flowable material may be placed directly in the chamber, however, for cleanliness and ease of use, it is preferred that the flowable material be contained within a separate container and the container housed in the reservoir chamber. The container may be a bag or a cartridge or any other suitable container for the flowable material, which may be housed in the reservoir chamber.

The reservoir chamber comprises means through which the flowable material may be loaded into it, for example, an open top or a door in the chamber. In a preferred embodiment, the reservoir chamber is fully enclosed but may have a movable or removable front door or panel. In a particularly preferred embodiment, a front panel is pivotally secured to the reservoir chamber along the bottom of the panel so that it may fold down for easy access to the reservoir chamber. This facilitates loading containers of flowable material into the reservoir chamber. To prevent unwanted opening of the front panel, the panel may be releasably secured to the reservoir chamber by any suitable means, for example, screws, latches, clips, etc. Screws are preferred as they provide a more secure closure to resist pressure from the flowable material inside the reservoir chamber.

In order to spread flowable material on to a surface, the flowable material must be able to flow out of the reservoir chamber. In this respect, the reservoir chamber is provided with an adjustable gate. The gate may be closed or opened prevent or permit dispensing of the flowable material from the reservoir chamber. Preferably, the gate is proximal the bottom of the reservoir chamber, which facilitates emptying of the reservoir chamber and permits better control over where the flowable material is dispensed on the surface. Preferably, the gate is complementary to the width of the pad retaining means, which permits dispensing of the flowable material over a wider swath resulting in more uniform coverage of a larger area and reducing the extent to which the spreading apparatus must be manipulated to spread an even coating thickness over said area. In such an arrangement, when the gate is open there is an opening in the reservoir chamber which spans substantially the width of the spreader pad. Flowable material is thereby dispensed along substantially the entire width of the spreader pad and the operator only has to pass the spreader pad a minimal number of times through the flowable material to obtain uniform spreading of the flowable material over the width of the spreader pad.

The gate may operate on any suitable principle. For example, the gate may pivot or slide away from an opening in the reservoir chamber. Preferably, the gate is pivotally attached to the reservoir chamber. The gate is preferably closed unless the operator actively opens the gate. The gate may be retained in a closed position by biasing means, which biases the gate towards the closed position. To ensure complete closure of the gate, a strong biasing force is desirable. Opening the gate is accomplished by applying a force to the gate which acts against the biasing force applied by the biasing means. The gate may be opened and enclosed with a gate opening means. In one embodiment, the gate opening means comprises an actuator and a cable, one end of the cable connected to the actuator and another end of the cable connected to the gate. Any suitable actuator, for example, a lever or a wheel and crank, may be used. The actuator is preferably selectively lockable so that the operator could lock the gate in an open position if desired. Locking the gate in an open position especially facilitates loading and unloading containers of flowable material in the reservoir chamber.

In the case where flowable material is loaded directly into the reservoir chamber, opening and closing the gate will automatically control dispensing. Where a container of flowable material is housed in the reservoir chamber, the container must cooperate with the gate to permit dispensing of the flowable material. For example, when the flowable material is contained within a bag, for example a plastic bag, an edge of the bag may be inserted through the gate so that a portion of the bag protrudes from the gate. Slitting or cutting away the edge of the bag permits the flowable material to flow and closing the gate results in pinching the protruding portion so that flowable material is prevented from flowing. In another embodiment, a cartridge may be equipped with a flexible seal along one edge with is inserted through the gate in a similar manner as the bag. Flowable material may be dispensed from the reservoir chamber by any suitable means, for example, by gravity or by a powered mechanism (human or otherwise) such as a plunger, a collapsing plate, a roller or pressurized fluid (e.g. air).

In the spreading apparatus, the reservoir chamber is preferably attached to the pad retaining means. More preferably, the reservoir chamber is pivotally attached to the pad retaining means to permit pivoting of the reservoir chamber frontwards and backwards. Such a configuration facilitates keeping the pad retaining means parallel to the surface thereby ensuring that the pad is always in full contact with the surface. This leads to more uniform spreading of the flowable material and accommodates operators of various heights.

The pad retaining means retains the spreader pad in a removable fashion. Thus, the pad may be removed and replaced without replacing the pad retaining means or the spreading apparatus. Preferably, retention of the spreader pad is accomplished without the use of springs and/or clips nor any other ancillary element requiring operator manipulation. In this way, the pad may be removed and replaced more easily and the spreading apparatus is less complicated to build and maintain.

In a first embodiment, the spreader pad is retained by frictional engagement of the pad within the pad retaining means. The pad retaining means may comprise a tight tolerance channel having two walls between which the spreader pad is retained by frictional engagement of the pad with the inside surfaces of the two walls. The channel may be closed at the top to prevent the pad from slipping too far up between the walls. Part of the spreader pad extends below the pad retaining means so that the spreader pad rather than the pad retaining means contacts the surface. Each or either end of the channel may be further extended at a right angle to form an U-shaped or an L-shaped channel. In particular, a U-shaped channel with a corresponding U-shaped spreader pad helps keep flowable material confined to the region behind the spreader pad when the flowable material is dispensed from the gate. In this embodiment, the spreader pad may comprise an elongated resilient foam member sufficiently thick to fit between and frictionally engage the walls of the channel, and sufficiently high to extend below the walls of the channel.

In a second embodiment of the spreader pad, the pad as described above is thicker than can be forced between the channel walls but comprises a groove separating an inner part from an outer part of the pad. The inner part is sufficiently thick to fit between and frictionally engage the channel walls and the outer part covers an outside surface of a channel wall, which fits within the groove. The spreader pad may comprise one groove to accommodate one wall or two grooves to accommodate both walls. In this way, the spreader pad completely protects the walls of pad retaining means from the flowable material being spread so that little or no clean-up of the pad retaining means is necessary.

In a third embodiment of the spreader pad, a pad similar to the first embodiment of the spreader pad may further comprise a beveled bottom. Preferably, the bottom is beveled so that the outside front face of the pad is less wide than the inside face. Beveling the bottom of the pad provides for better scraping action when pulling the spreading apparatus toward the operator and less build or pooling when pushing the spreading apparatus away from the operator. This leads to more even distribution of the flowable material on the surface.

In a fourth embodiment of the spreader pad, a pad similar to the first embodiment of the spreader pad may further comprise a serrated spreader blade mounted at a bottom edge of the pad, preferably the bottom inside edge. The serrated blade helps impart a pattern to the flowable material on the surface providing more effective contact between the flowable material and a covering being applied to the surface thereby leading to better adhesion. For further improvement in spreading performance, the blade may comprise one or more slits to impart greater flexibility to the spreader blade. The blade may be mounted to the pad by any suitable means, for example adhesives, bolts and/or engaged within grooves in the pad. Preferably, the blade is glued to the pad. More preferably, the blade is both glued to the pad and engaged within grooves in the pad. The blade may be made of any suitable hard material, for example plastics, metals, etc.

A spreader pad combining beveling as described above and a serrated spreader blade as described above provides for even better spreading performance.

The spreading apparatus also comprises a handle. The handle is preferably attached to and extends from the reservoir chamber, i.e. the handle is preferably not attached directly to the pad retaining means. The handle is preferably pivotally attached to the reservoir chamber so that the handle can pivot from side to side to facilitate spreading flowable material in corners and to more easily follow uneven contours of the surface. The handle is preferably curved near the top for greater ease of use.

The handle is preferably hollow, both to reduce weight and to provide a housing for the cable associated with the gate opening means. For ease of use, the actuator for the gate opening means is preferably secured to the handle where the operator can easily activate the gate with his hand, for example the actuator may be secured to an underside of the handle where the actuator can be activated by gripping. In such a case, the cable must run from the gate, up the handle to the actuator. By housing the cable inside the handle, the cable is out of the way and is protected from damage due to operator handling and errant flowable material.

The handle may also comprise an adjustable side grip. The side grip may be adjusted up or down to accommodate the operator's height as well as his arm length. The side grip may also be adjusted from side to side to accommodate a right or left handed operator.

The spreading apparatus may be made of any suitable material, for example, metal (e.g. galvanized steel, aluminized steel), high strength plastic (e.g. high density polyethylene, polypropylene), etc. Preferably, the spreading apparatus is made of a material or materials to which the flowable material does not readily stick. Typically, a metal or metals provides a good balance of machinability, cost and maintainability. The front panel of the reservoir chamber is preferably transparent to permit ready determination of the amount of flowable material remaining in the reservoir chamber. The gate preferably comprises a lining of "no stick" material, for example a polyfluorinated hydrocarbon such as Teflon™.

The spreading apparatus of the present invention may be used to spread any flowable material. The flowable material is preferably an adhesive and/or sealant for the installation of coverings on surfaces such as floors and walls. Coverings may be, for example, carpet, sheet plastic (e.g. vinyl), plastic tiles, ceramic tiles, composite strips and wood strips.

The spreading apparatus of the present invention advantageously provides improved spreading of flowable material on a surface. Flowable material may be spread more uniformly and over a greater area. Wastage of flowable material may be reduced. The apparatus may be easier to use, facilitating the loading of flowable material, facilitating spreader pad replacement, providing better access to corners, accommodating the height of different operators and accommodating both right handed and left handed operators. The apparatus is easier to keep clean and to maintain.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Figure 3:
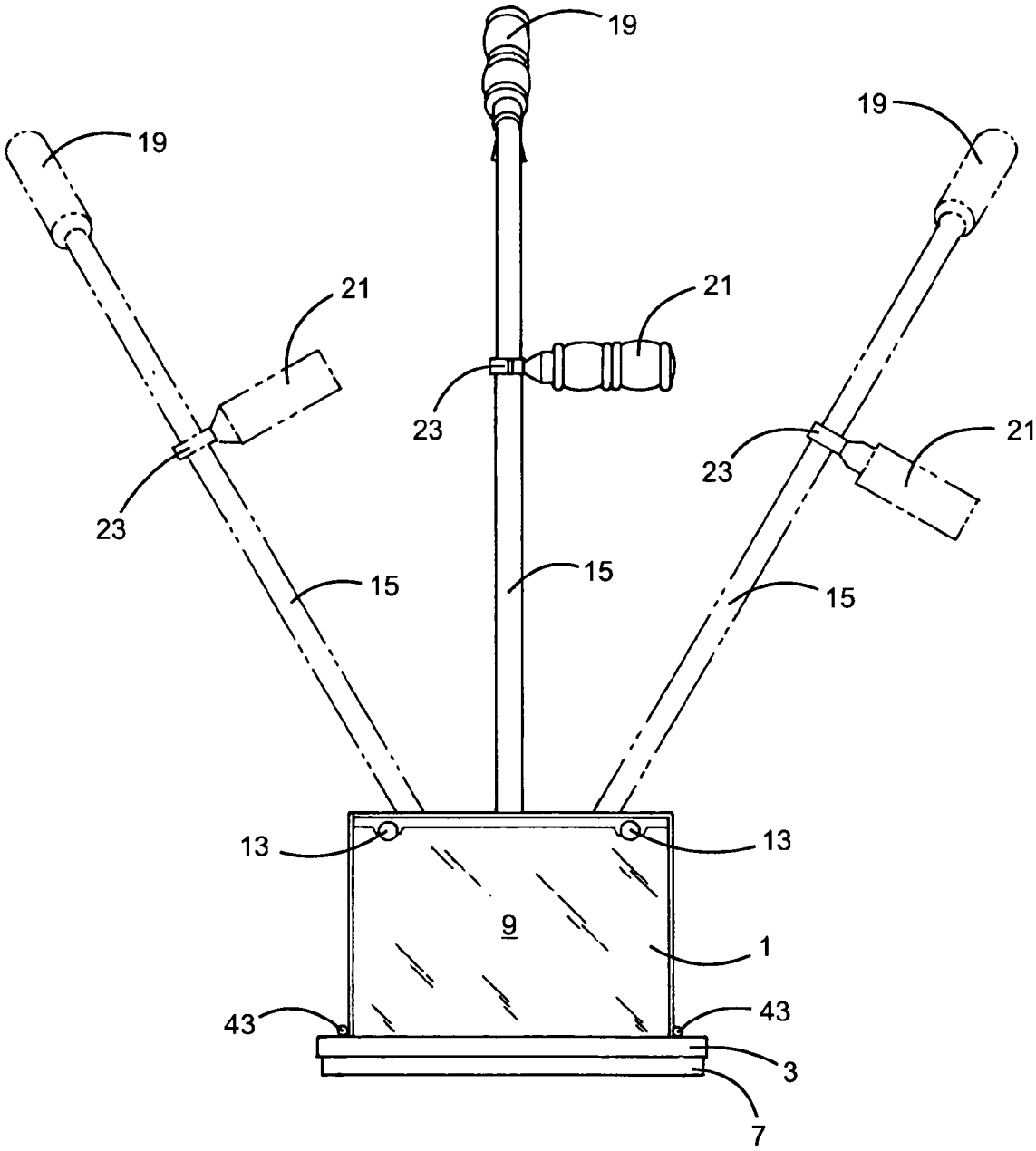
FIG. 3 is a front view of the spreading apparatus of FIG. 1.
Figure 4:
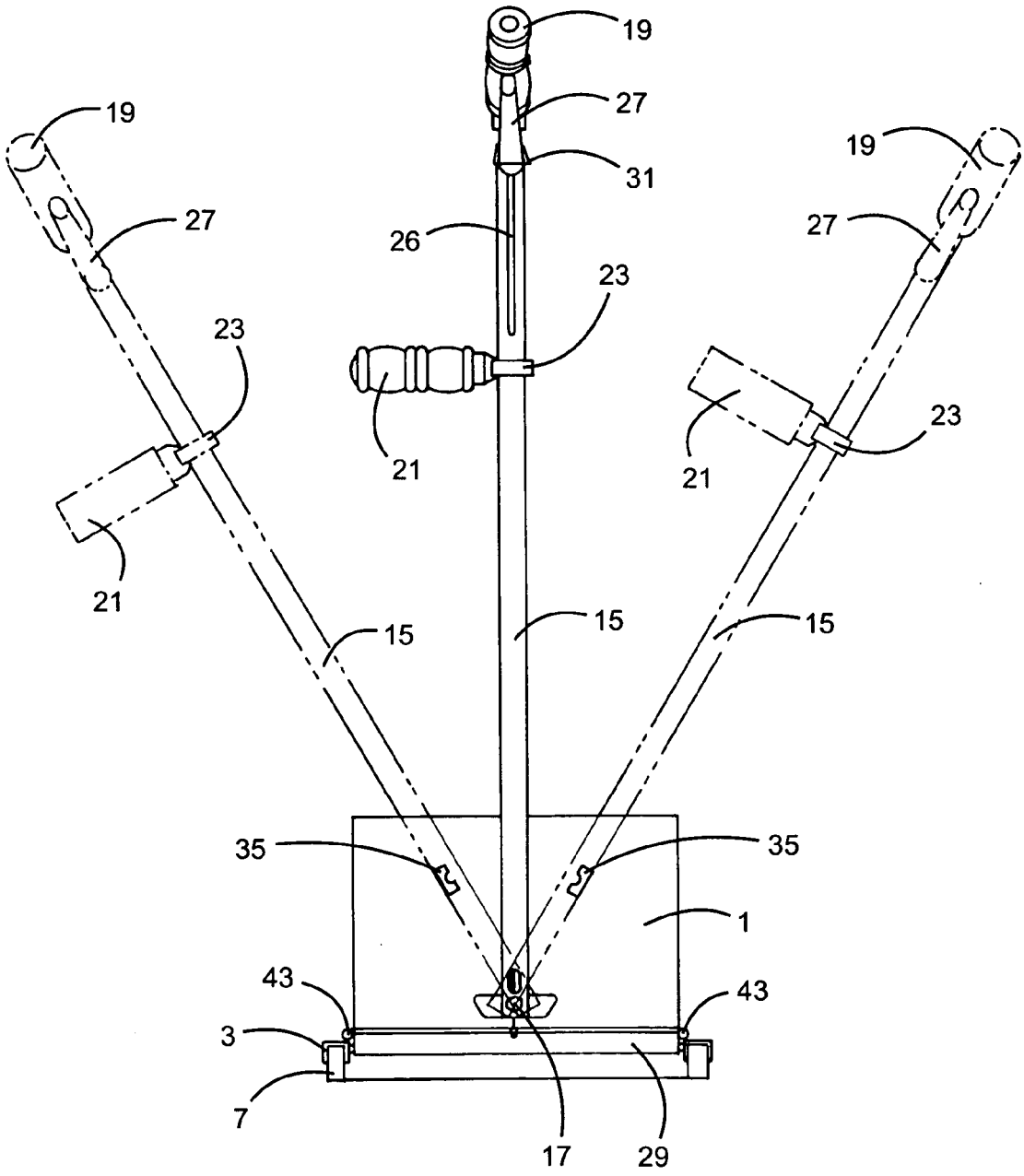
FIG. 4 is a back view of the spreading apparatus of FIG. 1.
Figure 5:
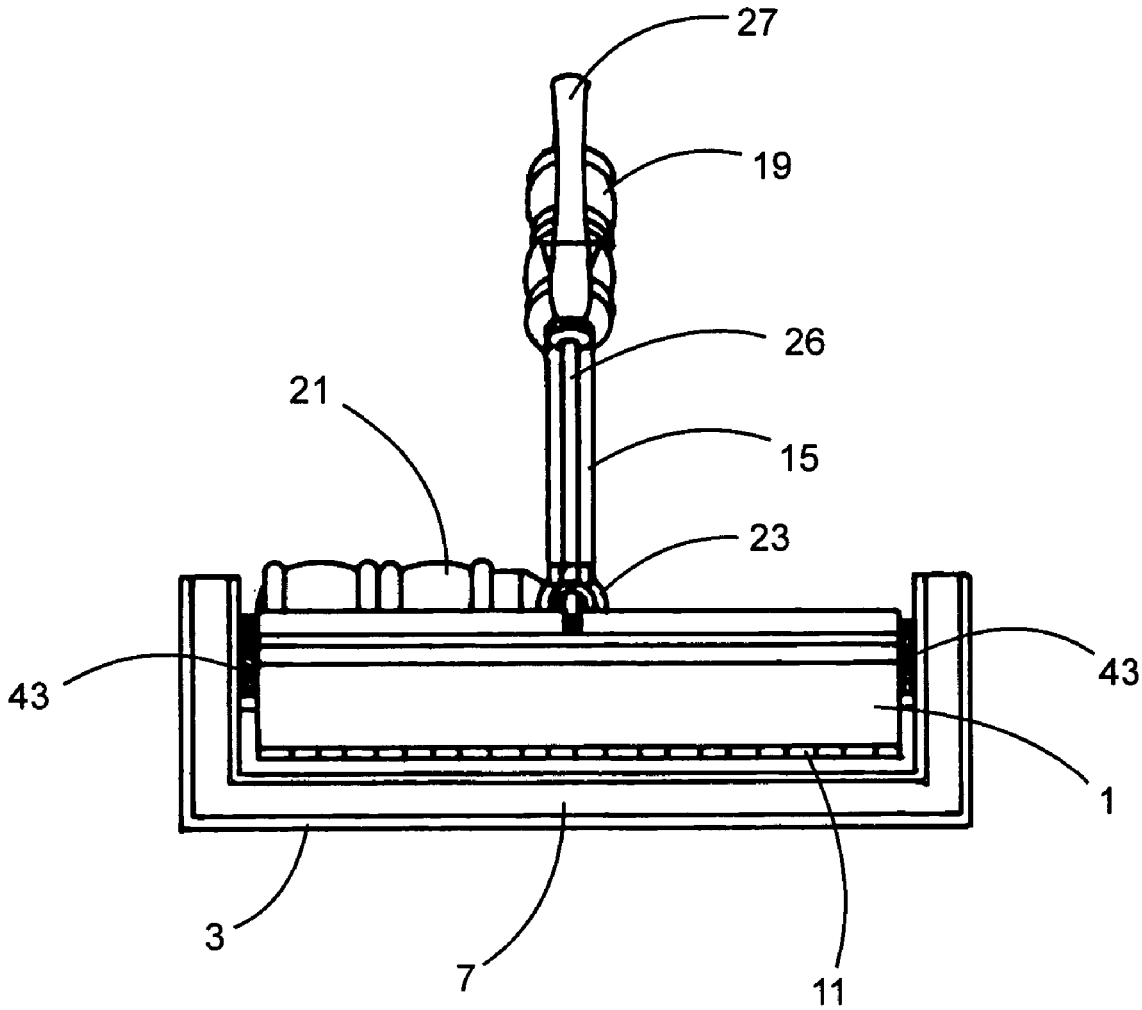
FIG. 5 is a bottom view of the spreading apparatus of FIG. 1.
Figure 6:
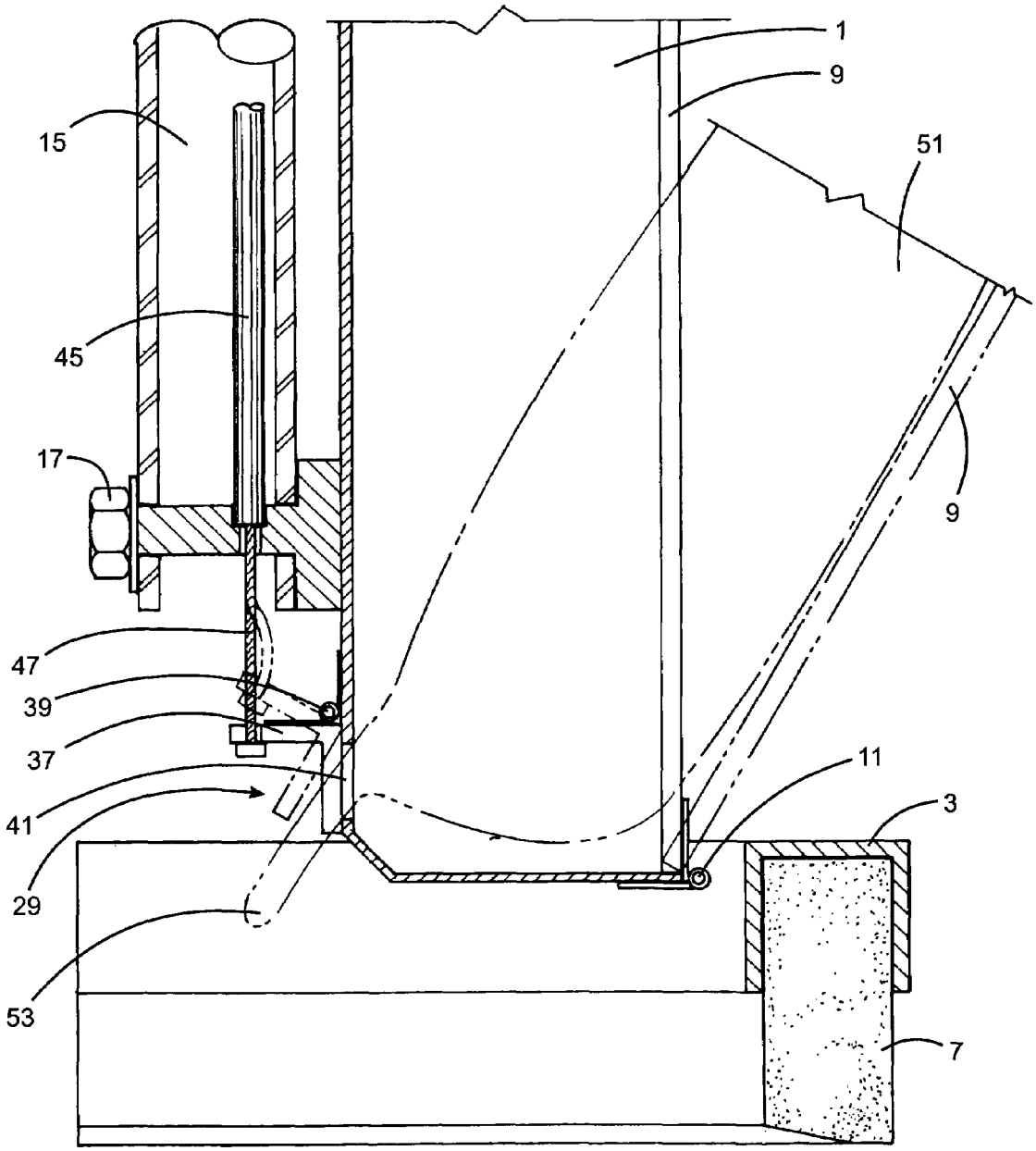
FIG. 6 is an enlarged side sectional view at the bottom of the spreading apparatus of FIG. 1.

Referring to FIGS. 1–8, an embodiment of a spreading apparatus of the present invention is illustrated. A reservoir chamber 1 in the shape of a rectangular prism having a top face, a bottom face, a front face, a back face and two side faces is pivotally attached to a U-shaped pad retaining means 3 by means of two bolts 5. Only one of the two bolts 5 is shown, the other bolt corresponding in position to the one bolt but located on the other side. As best seen in FIGS. 5 and 6, the U-shaped pad retaining means 3 comprises a tight tolerance channel having two arms each arm extending at right angles from each end of a cross-member. A U-shaped foam spreader pad 7 is inserted in the channel and is held in place by frictional engagement of the pad within the channel of the pad retaining means 3.

Figure 7:
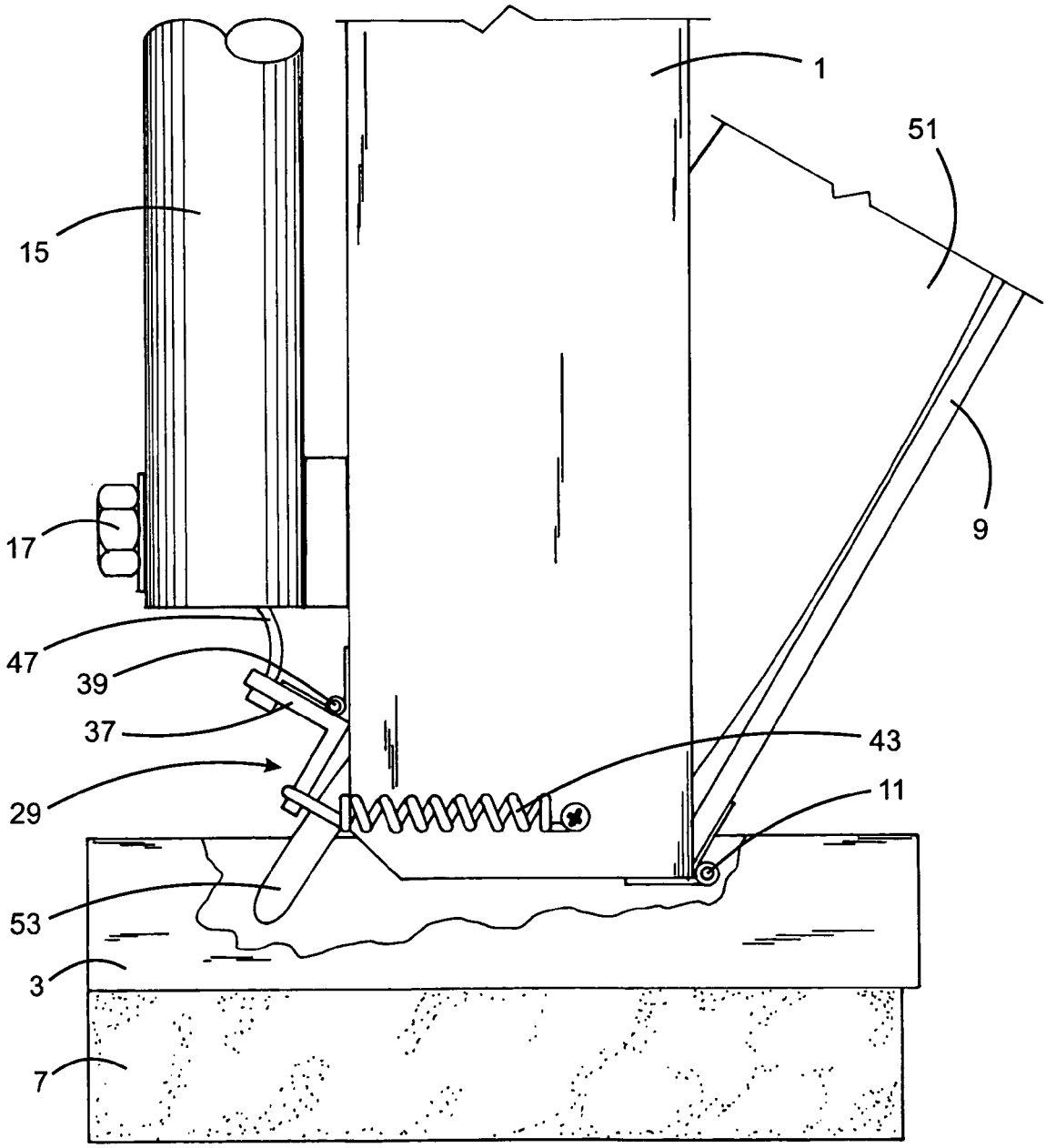
FIG. 7 is an enlarged side view at the bottom of the spreading apparatus of FIG. 1.

The front face of the reservoir chamber 1 is a transparent door 9 hinged at the bottom by a door hinge 11 running the width of the reservoir chamber (see FIGS. 5, 6 and 7 in particular). The transparent door 9 is secured to the reservoir chamber 1 proximal the top of the reservoir chamber by two screws 13.

A tubular hollow handle 15 having a top and a bottom is pivotally attached to the back face of and extends upward from the reservoir chamber 1. A single bolt 17 at the bottom of the handle 15 and proximal the bottom of the reservoir chamber 1 attaches the handle to the reservoir chamber and provides the point at which the handle pivots. The handle is curved proximal the top and terminates in a foam hand grip 19. An adjustable side grip 21 is secured to the handle 15 by a clamp 23 and may be adjusted left, right, up or down. In order to adjust the side grip 21, the clamp 23 may be loosened and tightened by rotating the side grip 21 about the longitudinal axis of threaded pin 25 which is perpendicular to the handle 15. A grip lever 27 is mounted to the handle 15 on the underside and at the top of the handle. A cable 26 extends from the grip lever 27 to an adjustable gate 29 located on the reservoir chamber 1. Operation of the gate 29 is explained below. A lock 31 is located on the grip lever 27 for locking the grip lever in a depressed position (i.e. when the gate 29 is open).

Figure 1:
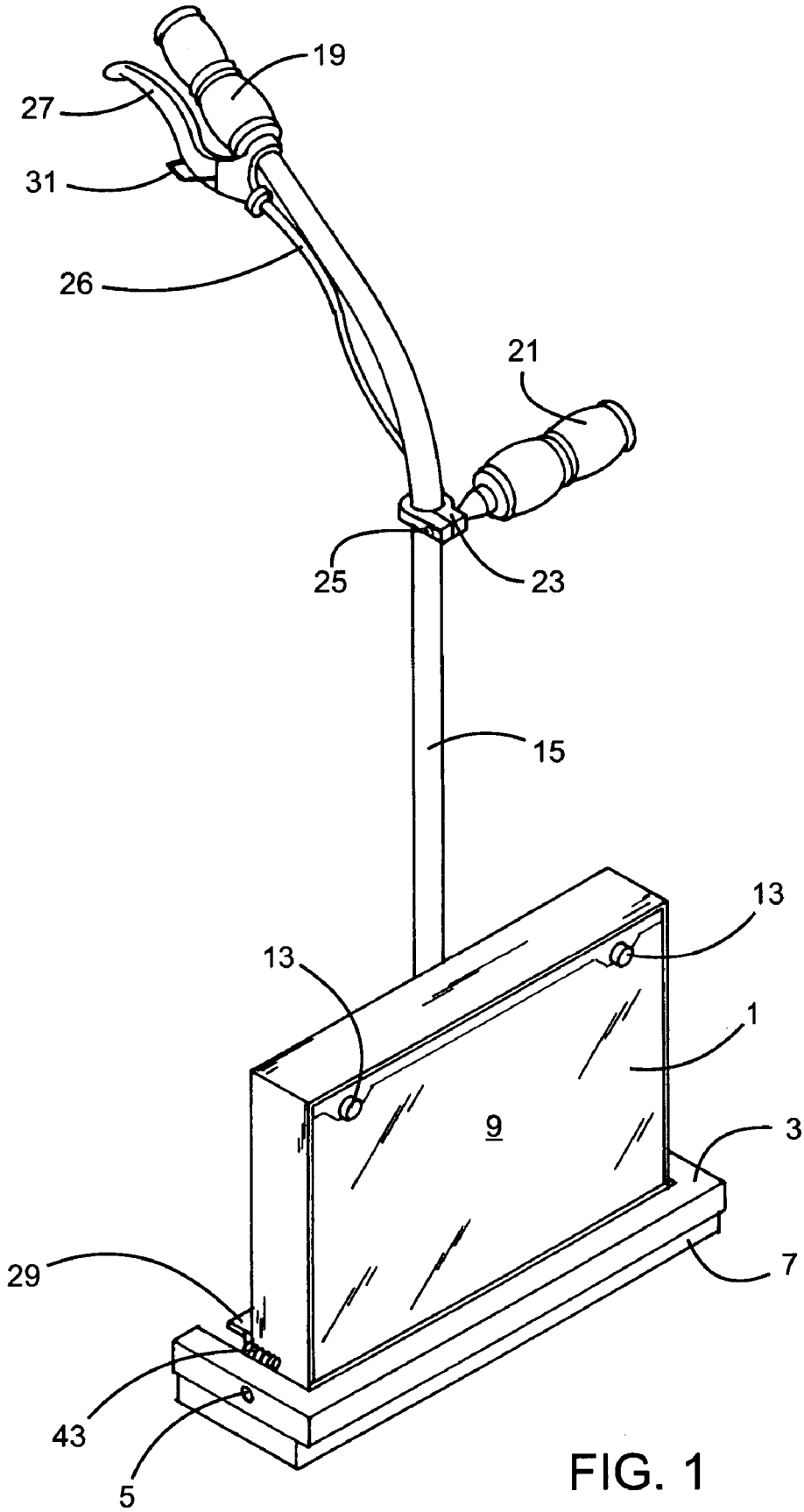
FIG. 1 is a perspective view of a spreading apparatus of the present invention.
Figure 2:
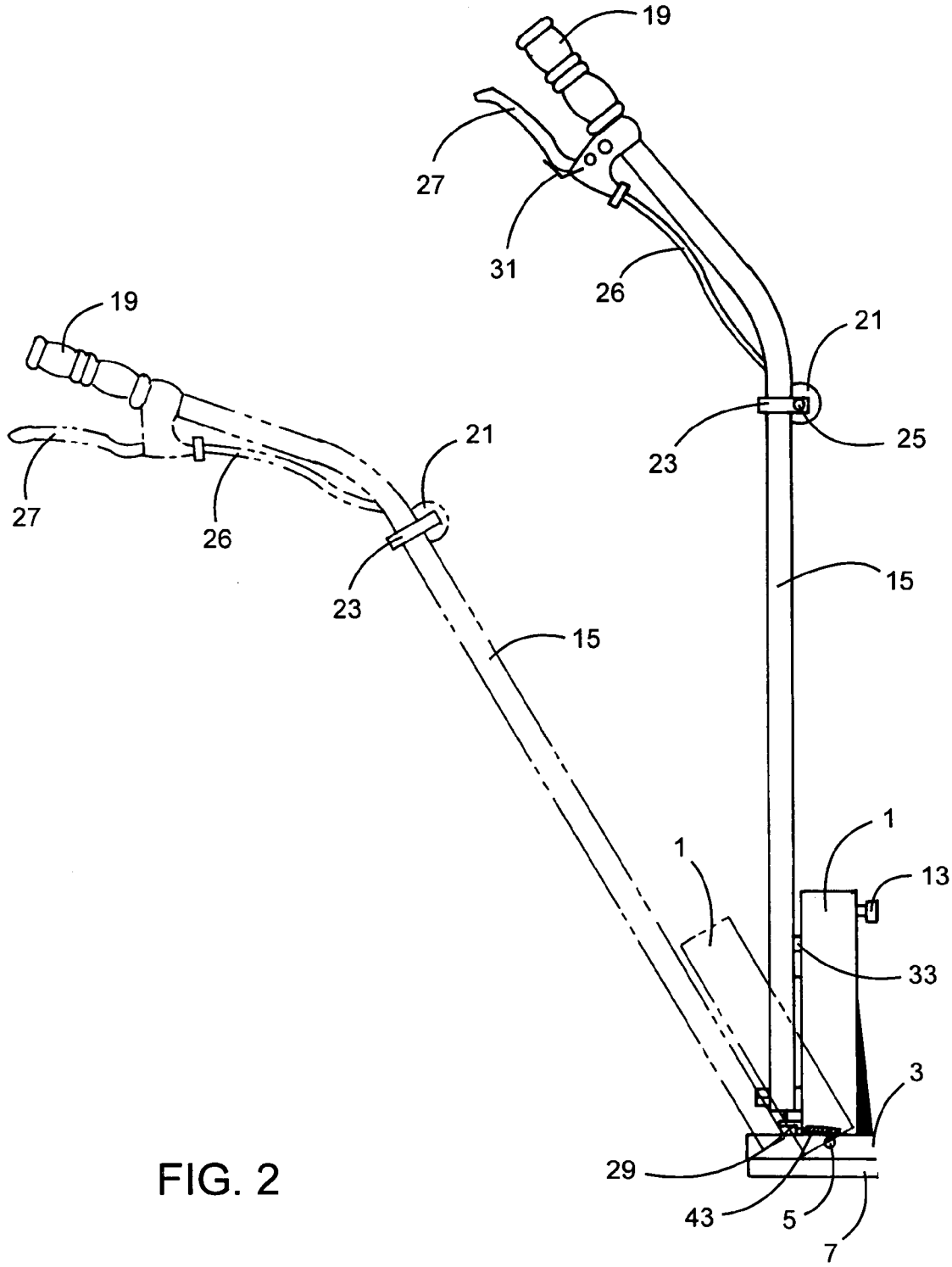
FIG. 2 is a side view of the spreading apparatus of FIG. 1.

As best seen in FIG. 2, pivoting of the reservoir chamber 1 on the bolts 5 permits backward and frontward pivoting of the reservoir chamber 1 (and the handle 15) while allowing the pad retaining means 3 to remain parallel to the surface and allowing the spreader pad 7 to remain in continuous contact with the surface (e.g. the floor) over the full spreading area of the pad. FIG. 2 illustrates two possible positions of the reservoir chamber 1 and the handle 15 in relation to the pad retaining means 3. One of the positions is illustrated in broken lines. Thus, the apparatus is efficiently utilizable by a person of any height.

As best seen in FIGS. 3 and 4, pivoting of the handle 15 on the bolt 17 permits side-to-side pivoting of the handle on the reservoir chamber 1 while allowing the reservoir chamber 1 and the pad retaining means 3 to remain in position. FIG. 3 illustrates three possible positions of the handle 15 in relation to the reservoir chamber 1. Two of the positions (a left position and a right position) are illustrated in broken lines. Thus, an operator can efficiently spread adhesive into corners. The handle 15 is provided with a plastic spacer 33 (see FIG. 2) attached to and located part way up the handle to maintain a gap between the handle 15 and the back of the reservoir chamber 1. The handle 15 is prevented from pivoting too far to either side by stops 35, which stop the spacer 33 when the handle 15 is pivoted to a side. As an alternative embodiment, the spacer may cooperate with an arcuate groove cut into the back of the reservoir chamber with the ends of the groove acting as the stops.

As best seen in FIGS. 4 and 5, the adjustable gate 29 is located along the bottom back edge of the reservoir chamber 1 and extends substantially the entire width of the reservoir chamber. Since the reservoir chamber 1 is located substantially within the entire inside distance between the two arms of the pad retaining means 3, it can be seen that the adjustable gate 29 is complementary to the width of the pad retaining means 3.

As best seen especially in FIGS. 5, 6 and 7, the adjustable gate 29 comprises a bracket 37 traversing the width of the reservoir chamber. The bracket comprises a first flange and a second flange forming a right angle. The first flange is attached to one panel of a panel hinge 39, while another panel of the panel hinge 39 is attached to the back face of the reservoir chamber 1. The second flange of the bracket 37 covers an opening 41 formed along the bottom of the back face of the reservoir chamber 1 over substantially the entire width of the reservoir chamber. Pivoting about the hinge pin of the panel hinge 39 permits movement of the second flange away from the opening 41 resulting in opening of the gate 29. The second flange of the bracket 37 is biased towards the opening 41 and held in place over the opening by a pair of springs 43 located at each end of the bracket 37. In this manner, the adjustable gate 29 is normally closed. Each of the springs 43 is attached to the second flange of the bracket 37 and a side face of the reservoir chamber 1.

As indicated above, a cable 26 extends from the grip lever 27 to the adjustable gate 29. The cable 26 is housed within the hollow handle 15 from substantially the grip lever 27 to the bottom of the handle. The cable 26 comprises an outer sheath 45, typically made of a plastic or rubber, and an inner wire 47, typically made of metal. The cable used on a bicycle brake is one example of a suitable cable. One end of the inner wire 47 is attached to the first flange of the bracket 37 at about the midpoint along the width of the reservoir chamber 1. Squeezing the grip lever 27 with sufficient force to overcome the biasing force of the springs 43 pulls up the inner wire 47 which slides within the outer sheath 45. Pulling on the inner wire 47 in turn pulls up the first flange of the bracket 37. Pulling up on the first flange causes the panel hinge 39 to pivot thereby pivoting the bracket 37. When the bracket 37 pivots in this manner, the second flange is pulled away from the opening 41 and the gate 29 is opened. Releasing the grip lever 27 permits the springs 43 to pull the second flange back over the opening 41 thereby closing the gate 29.

Figure 8:
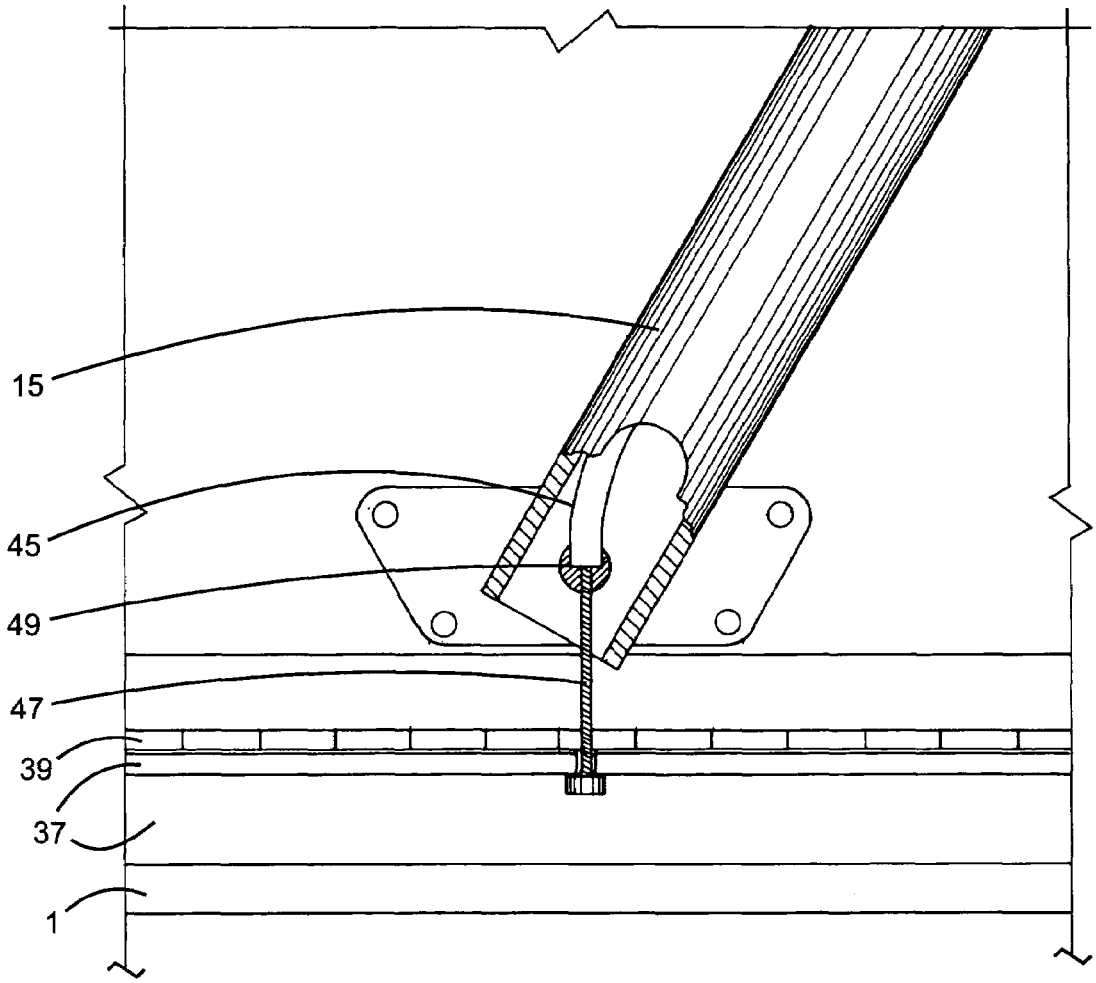
FIG. 8 is an enlarged back view near the bottom of the spreading apparatus of FIG. 1.

As best seen in FIGS. 6 and 8, in order to prevent accidental opening of the gate 29 caused by pulling on the cable 26 when the handle 15 is pivoted from side-to-side, the outer sheath 45 is fixedly secured at the pivot point 49 of the handle 15 while the inner wire 47 is not fixedly secured at the pivot point 49. Pivoting of the handle 15 will thereby cause the outer sheath 45 to flex without pulling on the inner wire 47.

As best seen in FIGS. 6 and 7, the transparent door 9 on the front face of the reservoir chamber 1 can open and close by pivoting on the door hinge 11. In order to load a bag 51 of adhesive into the reservoir chamber 1, the transparent door 9 is opened, the bag 51 is placed in the reservoir chamber 1 and an edge 53 of the bag along the entire width of the gate 29 is pushed through the open gate. To facilitate this operation, the lock 31 on the grip lever 27 may be engaged to keep the gate 29 open while the bag 51 is being loaded. Once the edge 53 of the bag 51 is pushed through the open gate along the entire width, the gate may be closed to pinch the bag thereby leaving a portion of the bag to protrude from the gate. The edge 53 of the bag may then be slit or cut away entirely. When the gate 29 is next opened, adhesive may then flow out of the slit or cut bag under the force of gravity to be deposited on the surface (e.g. the floor) where it can be spread by the action of the spreader pad 7. Allowing the gate 29 to close pinches the bag closed thereby stopping the flow of adhesive.

Referring to FIGS. 9A, 9B, 10A, 10B and 10C, three embodiments of a spreader pad of the present invention are illustrated. In all of these embodiments, the pads comprise a foam material suited for spreading an adhesive. A stiffer, denser foam is more suitable for spreading a thicker material such as tile grout while a less stiffness dense foam is suited for spreading a thinner material such as carpet glue. The heights of the pads are greater than the height of the channel in the pad retaining means so that at least some of the pad extends below the channel. Once a pad is worn down, it may be simply removed and replaced. In operation, adhesive is dispensed on the surface (e.g. floor) within the area bounded by arms and cross-member and the pad is drawn over the adhesive to spread it.

Figure 9A:
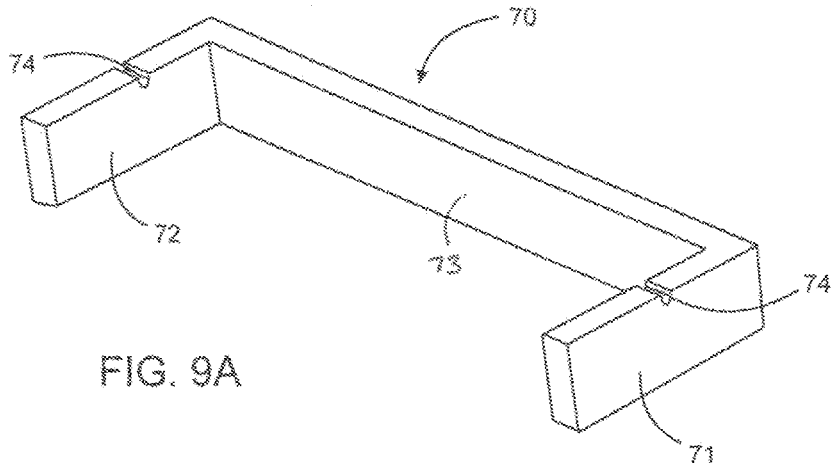
FIG. 9A is a perspective view of one embodiment of a spreader pad of the present invention.

Referring to FIG. 9A, a pad 70 is U-shaped having a two pad arms 71,72 and a pad cross-member 73. The two pad arms 71,72 extend at right angles in the same direction from respective ends of the pad cross-member 73. Slots 74 are cut into the pad on the pad arms 71,72 to accommodate the bolts denoted by reference numeral 5 in FIGS. 1–8. The pad 70 is sized to fit tightly into the tight tolerance channel of the pad retaining means so that under normal use conditions, the pad may be retained in the pad retaining means by frictional engagement while still being insertable and removable.

Figure 9B:
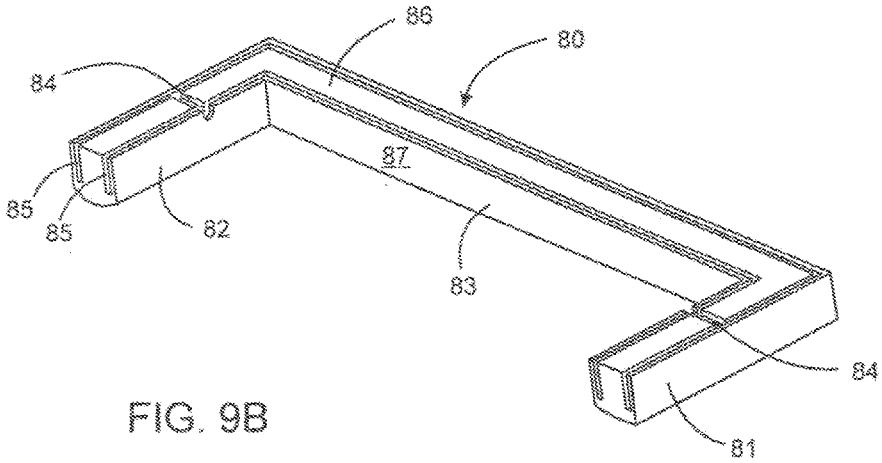
FIG. 9B is a perspective view of another embodiment of a spreader pad of the present invention.

Referring to FIG. 9B a pad 80 is U-shaped having a two pad arms 81,82 and a pad cross-member 83. The two pad arms 81,82 extend at right angles in the same direction from respective ends of the pad cross-member 83. In this embodiment, the entire pad 80 is thicker than can be forced into the channel of the pad retaining means but comprises two grooves 85 separating an inner part 86 from an outer part 87 of the pad 80. The inner part 86 is sufficiently thick to fit within and frictionally engage the channel of the pad retaining means and the outer part 87 covers outside surfaces of the pad retaining means. Walls of the channel fit within the groove 85. Slots 84 are cut into the pad on the pad arms 81,82 to accommodate the bolts denoted by reference numeral 5 in FIGS. 1–8. In operation, the pad 80 works similarly to the pad of FIG. 9A except that outside surfaces of the pad retaining means are protected from adhesive.

Figure 10A:
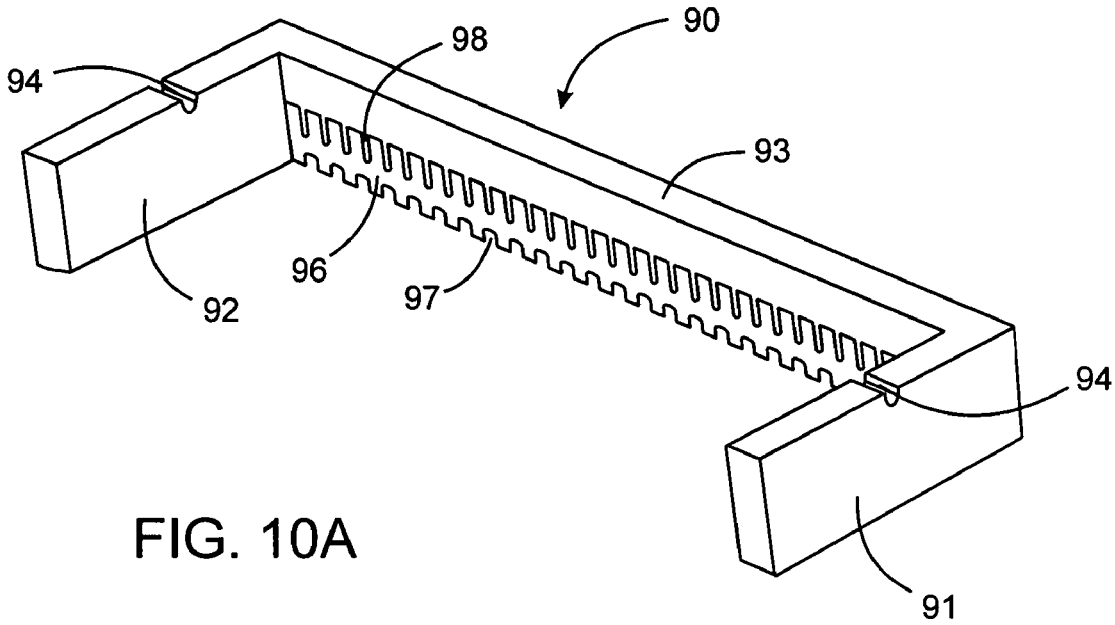
FIG. 10A is a perspective view of yet another embodiment of a spreader pad of the present invention.
Figure 10B:
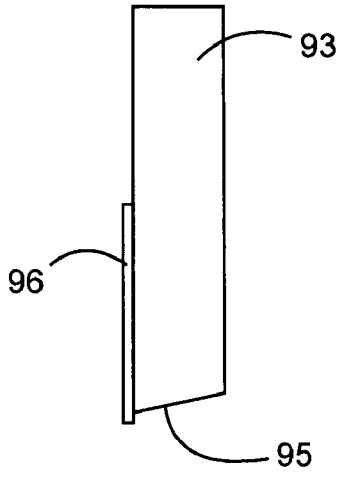
FIG. 10B is a side cross-sectional view of the spreader pad of FIG. 10A; and, FIG. 10C is a bottom view of the spreader pad of FIG. 10A.
Figure 10C:
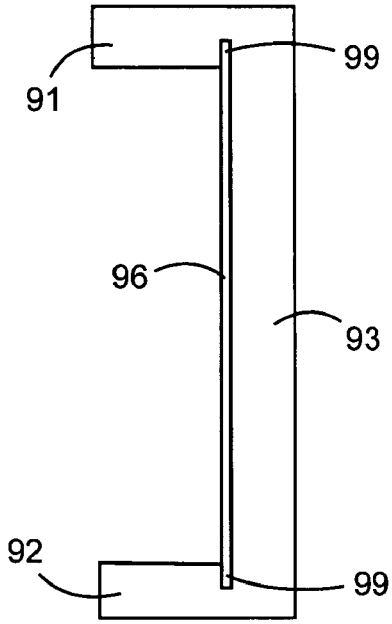

Referring to FIGS. 10A, 10B and 10C, a pad 90 is U-shaped having two pad arms 91,92 and a pad cross-member 93. The two pad arms 91,92 extend at right angles in the same direction from respective ends of the pad cross-member 93. Slots 94 are cut into the pad on the pad arms 91,92 to accommodate the bolts denoted by reference numeral 5 in FIGS. 1–8. The pad 90 is sized to fit tightly into the tight tolerance channel of the pad retaining means so that under normal use conditions, the pad may be retained in the pad retaining means by frictional engagement while still being insertable and removable. A serrated spreader blade 96 having a plurality of serrations 97 (only one labeled) is glued to an inside face of the cross-member 93 at a bottom edge thereof. As best seen in FIG. 10C, the blade 96 is also engaged within grooves 99 cut into the arms 91,92. The blade further comprises a plurality of vertical slits 98 (only one labeled) to impart greater flexibility to the blade. As best seen in FIG. 10B, the cross-member 93 has a beveled bottom 95 such that the serrated spreader blade 96 extends below the inside bottom edge of the cross-member. The beveled bottom 95 results in the outside bottom edge of the cross-member being higher off the surface than the inside bottom edge of the cross-member, i.e. the outside face of the cross-member is narrower in height than the inside face of the cross-member.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A pad for an apparatus with a pad retaining means, for spreading a flowable material onto a surface, the spreader pad comprising:

an elongated resilient foam member sufficiently thick to fit within and frictionally engage the pad retaining means, and sufficiently high to extend below the pad retaining means so that the spreader pad rather than the pad retaining means contacts the surface when the spreader pad is retained by the pad retaining means, and a serrated spreader blade mounted at a first bottom edge of the elongated resilient foam member.

2. The pad of claim 1 wherein the foam member has an inner part sufficiently thick to fit within and frictionally engage inside surfaces of two walls of a tight tolerance channel of the pad retaining means, and has an outer part that covers an outside surface of one or both of the channel walls, and one or more grooves between the inner and outer parts within which one or both of the channel walls may fit.

3. The pad of claim 2, wherein the foam member comprises two grooves, one for each channel wall.

4. The pad of claim 3, wherein the foam member is U-shaped.

5. The pad of claim 4, wherein the foam member has two arms extending at right angles from respective ends of a cross-member.

6. The pad of claim 1, wherein the serrated spreader blade comprises one or more slits to impart greater flexibility thereto.

7. The pad of claim 1, wherein the serrated spreader blade is engaged within one or more grooves in the foam member.

8. The pad of claim 1, wherein the foam member is U-shaped having two arms extending at right angles from respective ends of a cross-member, and the serrated spreader blade is mounted at a first bottom edge of the cross-member.

9. The pad of claim 1, wherein the elongated resilient foam member has a beveled bottom.

10. The pad of claim 9, wherein the beveled bottom has an outside edge and an inside edge, the outside edge higher off the surface than the inside edge.

11. A pad for an apparatus with a pad retaining means, for spreading a flowable material onto a surface, the spreader pad comprising:

an elongated resilient foam member sufficiently thick to fit within and frictionally engage the pad retaining means, and sufficiently high to extend below the pad retaining means so that the spreader pad rather than the pad retaining means contacts the surface when the spreader pad is retained by the pad retaining means, wherein the elongated resilient foam member is U-shaped with two arms extending at right angles from respective ends of a cross-member that has a beveled bottom, the beveled bottom having an outside edge and an inside edge, with the outside edge higher off the surface than the inside edge.

12. A pad for an apparatus with a pad retaining means, for spreading a flowable material onto a surface, the spreader pad comprising:

a U-shaped elongated resilient foam member, having two arms extending at right angles from respective ends of a cross member, the foam member being sufficiently thick to fit within and frictionally engage the pad retaining means with the arms and cross member fitting within and frictionally engaging a tight tolerance channel on the pad retaining means, and sufficiently high to extend below the pad retaining means so that the spreader pad rather than the pad retaining means contacts the surface when the spreader pad is retained by the pad retaining means, the cross-member having a beveled bottom with an outside edge and an inside edge, the outside edge being higher off the surface than the inside edge; and cross-member having a serrated spreader blade mounted thereon; and the serrated spreader blade mounted on the cross member at the inside edge of the beveled bottom, the spreader blade having one or more slits therein to impart greater flexibility thereto.

* * * * *